US006006705A

United States Patent [19]

Kato et al.

[11] Patent Number: 6,006,705

[45] Date of Patent: Dec. 28, 1999

[54] FUEL INJECTION SYSTEM

[75] Inventors: Masahiko Kato; Hitoshi Watanabe, both of Hamamtsu, Japan

[73] Assignee: Sanshin Kogyo Kabushiki Kaisha, Hamamatsu, Japan

[21] Appl. No.: 08/828,427

[22] Filed: Mar. 28, 1997

[30] Foreign Application Priority Data

Mar. 29, 1996 [JP] Japan ..... 8-076379

[51] Int. Cl.[6] ..... B63H 21/26

[52] U.S. Cl. ..... 123/73 AD

[58] Field of Search ..... 123/73 AD, 73 A

[56] References Cited

U.S. PATENT DOCUMENTS 4,471,727 9/1984 Odashima .

4,637,355 1/1987 Odashima .

*Primary Examiner*—Marguerite McMahon

*Attorney, Agent, or Firm*—Knobbe, Martens, Olson & Bear LLP

[57] ABSTRACT

A fuel system for an internal combustion engine powering an outboard motor of a watercraft is disclosed. The fuel system includes a main fuel source and a pump for delivering fuel from the main fuel source through a fuel filter to a vapor separator. Fuel is supplied from the chamber by high pressure pump through a fuel rail to one or more fuel injectors. Undelivered fuel is returned to the vapor separator through a return line. Oil is mixed into the fuel between the fuel filter and the high pressure pump, so that the high pressure pump draws a mixture of fuel and oil and delivers it to the charge former(s) and fuel return.

9 Claims, 12 Drawing Sheets

FUEL INJECTION SYSTEM

FIELD OF THE INVENTION

The present invention relates to a fuel system. More specifically, the invention relates to a fuel system including at least one fuel injector, a fuel source, a vapor separator, and means for delivering a mixture of oil and fuel from the separator to the fuel injector(s).

BACKGROUND OF THE INVENTION

Fuel systems for internal combustion engines powering outboard motors typically include a vapor separator. In these fuel systems, fuel is supplied from a tank to the vapor separator. A high pressure pump delivers the fuel from the separator through a fuel rail to individual fuel injectors.

Fuel which is supplied to the fuel rail but not distributed by the injectors is preferably re-routed back into the fuel system. Because the undistributed fuel is agitated, it may contain air bubbles and is thus passed into the vapor separator. The vapor separator is designed to allow the air within the fuel to separate from the fuel, which fuel is then routed back into the fuel delivery line to the fuel injectors.

In order to reduce corrosive effects upon the various fuel system components, oil is preferably supplied into the fuel for distribution through the fuel system. The oil may be used to lubricate the passages, springs, plungers and other fuel system components.

A problem arises from the fact that oil has a higher specific gravity than the fuel, and as such, the oil may settle to and remain at the bottom of the vapor separator. In addition, when the watercraft is accelerating, the settled oil may be drawn to that portion of the separator opposite the high pressure fuel pump intake. When the oil is so located, and because once separated it resists flow, the high pressure pump is unsuccessful in drawing oil along with fuel from the vapor separator.

A fuel system including a vapor separator adapted to separate vapor from fuel and from which a well-mixed supply of fuel and oil may be drawn, is desired.

SUMMARY OF THE INVENTION

A fuel system for an internal combustion engine of the type utilized to power an outboard motor of a watercraft is disclosed. The fuel system includes a fuel circuit to which oil is added. The fuel circuit includes a pump for delivering fuel from a main fuel supply tank through a fuel filter to a chamber of a vapor separator. A second pump draws fuel from the chamber and delivers it, preferably through a fuel rail, to one or more charge formers. A fuel return to the vapor separator is provided for returning fuel which is not delivered by the charger former(s).

In accordance with the present invention, oil is supplied to the fuel in a manner which promotes mixing of the oil and fuel, whereby and oil and fuel mixture is provided by the second pump to the charge former(s). Preferably, the oil is supplied to the fuel circuit between the fuel filter and an intake of the second pump.

In a first preferred embodiment, the fuel return includes a port or passage extending to the chamber of the separator, and oil is supplied into the fuel passing through that passage. In this arrangement, the oil and returned fuel are mixed and delivered to fuel within the vapor separator.

In another embodiment, oil is supplied through a first port in the vapor separator and fuel is returned from the charge former(s) through a second port, with the streams of oil and returned fuel crossing, thereby mixing the oil and fuel.

In another embodiment, the oil is delivered through a port positioned above a float of the vapor separator, whereby the oil entering the chamber impacts the float and is dispersed into the fuel within the vapor separator.

In another embodiment, fuel from the main fuel tank passes through a passage into the vapor separator, and the oil is supplied into this passage for mixing with the incoming fuel.

In another embodiment, oil is supplied through a port positioned in the bottom of the separator adjacent the intake of the second pump.

In another embodiment, the vapor separator has a bottom surface which is slanted in the direction of the intake of the second pump, and the oil is supplied through a port positioned along an elevated portion of the bottom surface.

In another embodiment, the primary fuel supply and returned fuel are delivered into the vapor separator through a single port positioned above an oil supply port.

In yet another embodiment, the vapor separator is arranged so that the second pump is positioned in a portion of the vapor separator closest the watercraft, and oil is supplied through a port near the high pressure pump intake.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, an internal combustion engine is provided with an improved fuel system including a vapor separator adapted to provide a source of well-mixed oil and fuel for delivery to one or more charge formers of the engine.

Figure 1:
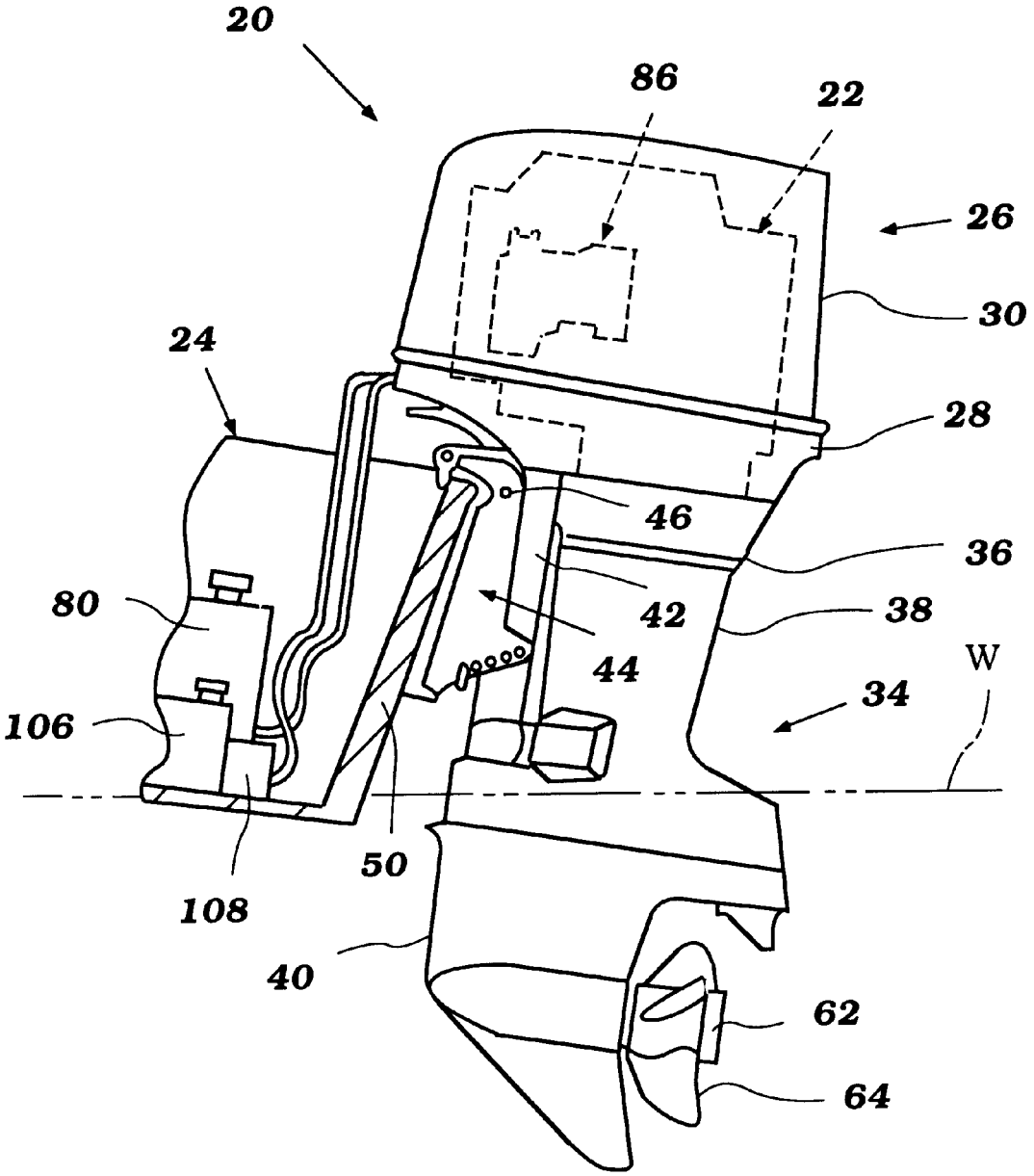
FIG. 1 is a side view of an outboard motor connected to a watercraft, the outboard motor powered by an internal combustion engine (illustrated in phantom)

FIG.1 illustrates an outboard motor 20 of the type which is advantageously powered by an engine 22 having a fuel system in accordance with the present invention. The motor 20 is utilized to power a watercraft 24. The outboard motor 20 has a powerhead area 26 comprised of a lower tray portion 28 and a main cowling portion 30. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket 42. The steering shaft is supported for steering movement about a vertically extending axis within a swivel bracket 44. The swivel bracket 44 is connected by means of a pivot pin 46 to a clamping bracket 48 which is attached to a transom portion of a hull 50 of the watercraft. The pivot pin 46 permits the outboard motor 20 to be trimmed and tilted up about the horizontally disposed axis formed by the pivot pin 46.

Figure 2:
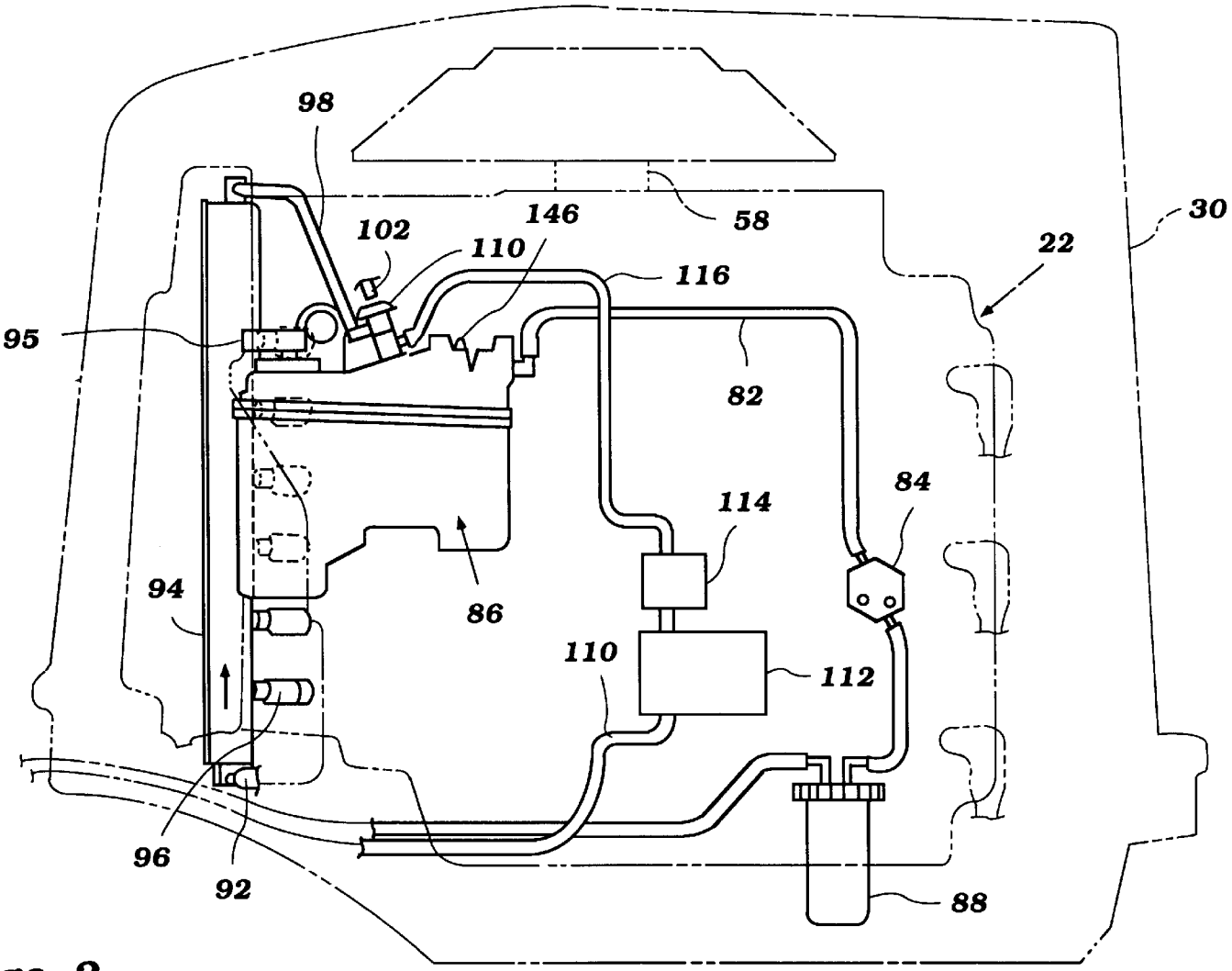
FIG. 2 is a side view of the engine of the motor illustrated in FIG. 1 as including a fuel system in accordance with a first embodiment of the present invention, with a cowling of the motor illustrated in phantom.
Figure 3:
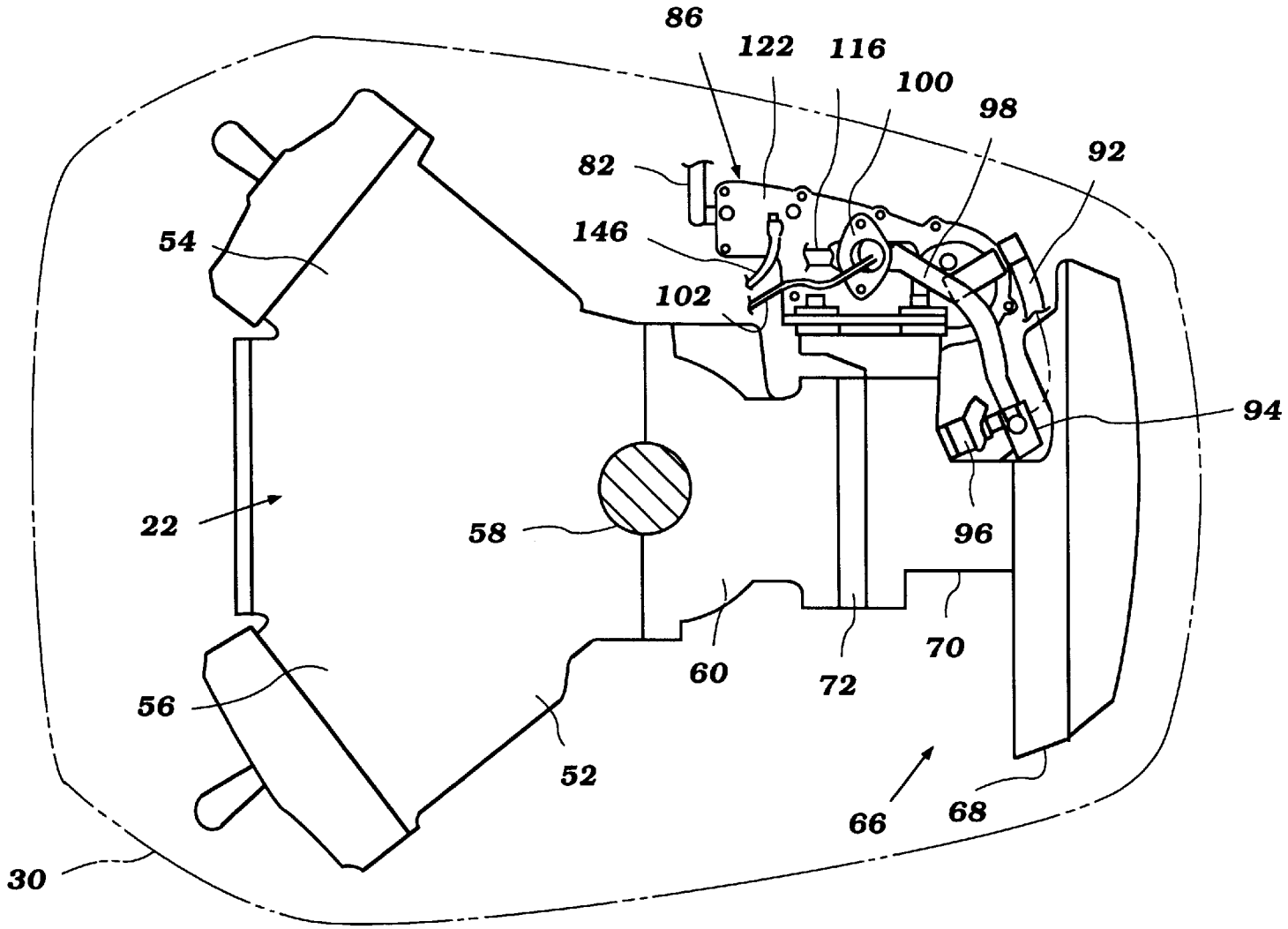
FIG. 3 is a top view of the engine including the first embodiment fuel system of the outboard motor illustrated in FIG. 1 with a cowling of the motor illustrated in phantom.

As best illustrated in FIGS. 2 and 3, the power head 26 of the outboard motor 20 includes the engine 22 which is positioned within the cowling portion 30. The engine 22 is preferably of the "V"-type, preferably having six cylinders. The engine 22 is of the two-cycle variety, and includes a first cylinder bank 54 formed by a first cylinder head assembly connected to the cylinder block 52, and a second cylinder bank 56 formed by a second cylinder head connected to the cylinder block 52. As the engine 22 is of the "V-6" variety, each cylinder bank 54,56 preferably includes three combustion chambers. As is well known to those skilled in the art, each combustion chamber has a piston (not shown) mounted therein for reciprocation, the piston connected to the crankshaft 58 via a connecting rod.

As may be appreciated by those skilled in the art, the engine 22 may have as few as one combustion chamber per bank, or as many as six or more. In addition, while the present invention is described and illustrated for use with a "V"-type, two-cycle engine, the invention is useful with other types and arrangements of engines, such as engines arranged in inline or opposed fashion. As also illustrated in FIGS. 2 and 3, the engine 22 is preferably oriented within the cowling 30 such that its cylinder heads 54,56 are positioned on the block 52 on the side opposite the watercraft's transom.

A crankshaft 58 is rotatably journalled in a crankcase chamber (not shown) formed by the cylinder block 52 a crankcase cover 60. As is typical with outboard motor practice, the engine 22 is mounted in the power head 26 so that the crankshaft 58 rotates about a vertically extending axis. This facilitates coupling to a drive shaft (not show), which depends into the lower unit 34, wherein it drives a conventional bevel gear and a forward-neutral-reverse transmission. The transmission is not illustrated herein, because its construction per se forms no part of the invention. Therefore, any known type of transmission may be employed.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art. When the motor 20 is in use in propelling the watercraft 24, the propeller 64 is positioned under a water line W and within the body of water.

The construction of the engine 22 and fuel system of the present invention will now be described in more detail.

As the engine 22 is of the two-cycle variety, it includes a crankcase compression arrangement. As illustrated in FIG. 3, an intake system provides air to each combustion chamber. The intake system 66 includes an air intake or silencer 68 positioned within the cowling 30. Air drawn through this intake 68 passes into air passages formed within an intake manifold 70. A passage is provided in the manifold 70 corresponding to each combustion chamber.

A reed valve body 72 is positioned between the manifold 70 and the crankcase cover 60. The body 72 has passages therethrough corresponding to each passage through the intake manifold 70. Each passage through the body 72 has a reed valve positioned therein for controlling the flow of an air and fuel mixture therethrough.

As is known to those skilled in the art, and thus not described in detail here, the air and fuel mixture is selectively drawn through the reed valves into individual crankcase chambers within the crankcase corresponding to each combustion chamber. The air and fuel mixture is drawn from the crankcase chambers into the combustion chambers through scavenge passages, and is combusted in the combustion chambers.

A suitable exhaust system (not shown) is provided for routing the products of combustion within the combustion chambers to a point external to the engine. Likewise, a suitable ignition system is provided for igniting the air and fuel mixture within each combustion chamber at the desired time.

Figure 5:
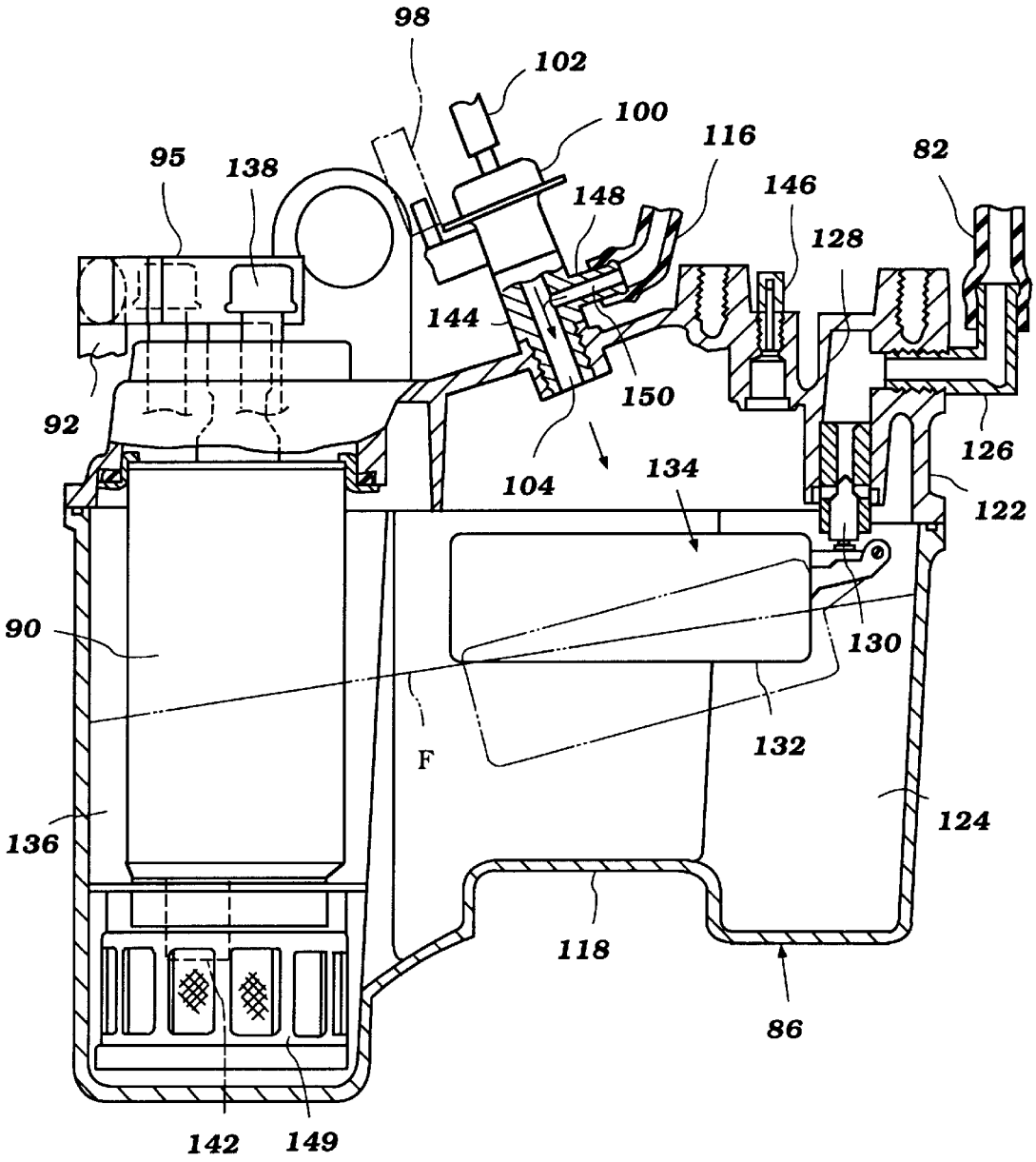
FIG. 5 is a cross-sectional view of the vapor separator illustrated in FIG. 4 and taken along line 5—5 therein.

The fuel system in accordance with a first embodiment of the present invention is illustrated generally in FIGS. 1, 2 and 5. Fuel is stored within the watercraft 24 within a fuel tank 80. Fuel is delivered from the tank 80 through a main fuel supply line 82 by a low pressure fuel pump 84, to a vapor separator 86. Preferably, the fuel passes through fuel filter 88 positioned along the supply line 83, for filtering foreign matter from the fuel.

Fuel supplied to the vapor separator 86 is pumped therefrom by a high pressure fuel pump 90 to a high pressure fuel line 92 to a fuel rail 94. The fuel is supplied from the rail 94 through ports to individual charge formers.

As best illustrated in FIGS. 2 and 3, the charge former is a fuel injector 96. An injector 96 is provided for each intake passage through the intake manifold 70. The injector 96 is positioned to inject fuel supplied from the rail 94 into the air passing through the passage in the manifold 70.

Fuel which is not supplied through the fuel injectors 96 passes through a fuel return line 98 to a pressure regulator 100, and thereon through a passage 104 back into the vapor separator 86. A low pressure line 102 provides a pressure reference to the pressure regulator 100, as is known in the art. This pressure line 102 may lead to the intake manifold 70 or another location for providing the pressure reference.

In the arrangement of the present invention, lubricating oil is supplied to the fuel, whereby an oil and fuel mixture may be drawn by the high pressure fuel pump 90 for delivery to the fuel injectors 96. A lubricating oil reservoir 106 is preferably provided in the watercraft 24. Oil is drawn from the reservoir 106 by a pump 108 and delivered through an oil supply line 110 to a sub-oil tank 112 positioned within the cowling 30 of the motor. Oil is drawn from this sub-tank 112 by a second pump 114 and delivered to the vapor separator 86 through a main oil supply line 116.

In accordance with the present invention, the oil is supplied to the fuel in a manner which causes the oil and fuel to mix thoroughly. In addition, the present invention prevents the oil from being delivered to the separator 86, being separated from the fuel, and then being moved about the separator in response to watercraft movement thereby preventing the oil from being drawn by the high pressure pump.

As illustrated in FIG. 5, the vapor separator 86 includes a main body 120. A lid 122 is connected to a top of the body 120, the lid and body cooperating to form therein a separating chamber 124.

The main fuel supply line 82 supplies fuel to the chamber 124 of the vapor separator 86 through a port or passage in the separator. In particular, the supply line 82 is preferably connected to a fuel inlet pipe 126 leading to a main fuel passage 128 through the lid 122 into the chamber 124. As illustrated, the fuel inlet pipe 126 is preferably "L"-shaped and threadingly engages the lid 122.

A valve 134 is provided for controlling the flow of fuel through the main fuel passage 128 to the chamber 124. Preferably, this valve 134 comprises a float 132 positioned within the chamber 124 and connected to a metering needle 130. When the fuel and oil level within the chamber 124 is low, the float 132 moves to the position illustrated in phantom in FIG. 5. In this position, the needle 130 is pulled downwardly out of the passage 128, allowing fuel to flow through the passage into the chamber. On the other hand, when the fuel level in the chamber 124 is high, the float 132 moves to the position illustrated in solid lines in FIG. 5, and the needle 130 is pressed upwardly into the passage 128 to a position in which is obstructs the passage and prevents the flow of fuel therethrough.

As best illustrated in FIG. 5, the high pressure pump 90 is positioned within a pumping chamber 136 defined within the vapor separator 86. The pump 90 has first and second electrical terminals 138,140 to which electrical wiring is connected. The electrical wiring leads to a power source for powering the pump 90.

The pump 90 has an intake or inlet 142 positioned with a secondary filter 144 positioned in the chamber 124. The filter 144 is used to remove foreign matter from the oil and fuel mixture which is drawn by the pump 90.

The pump 90 has an outlet 95 leading to the high pressure supply line 92, as described in detail above.

As is known to those skilled in the art, the separator 86 is adapted to separate air and vapor from the fuel and oil within the chamber 124. This gas is routed through a discharge pipe 146 from the separator. Preferably, the pipe 146 leads to one or more of the crankcase chambers.

Fuel which is returned through the return line 98 enters the pressure regulator 100. The returned fuel is routed through a port or passage into the separator 86 from the regulator 100. Preferably, the returned fuel passes through a passage 104 in a body 144 of the regulator 100 into the chamber 124 in the vapor separator 86. As illustrated, the fuel returned preferably passes through the lid 122 of the separator 186.

In accordance with the present invention, the oil which is supplied to the separator 86 is preferably mixed with the fuel. As illustrated in FIG. 5, the oil supply line 116 extends to a branch 148 of the body 144 of the pressure regulator 100. The oil flows through the line 116 to a passage 150 in the branch 148 leading to the main passage 144. As the oil flows into the passage 144, it is mixed with the fuel returned from the return line 98.

In this arrangement, the oil is thoroughly mixed with the fuel for delivery by the high pressure pump 90 to the fuel injectors 96. In addition, the separator 86 is arranged to prevent the oil from settling to the bottom of the chamber 124 and moved to a portion thereof where is not picked up by the pump. In particular, as illustrated in FIG. 5, if the watercraft is accelerating or the motor is trimmed so that the top surface of the fuel is along line F therein, the lubricating oil is drawn by gravity and the flow of liquid is towards the intake of the high pressure pump 90.

Figure 6:
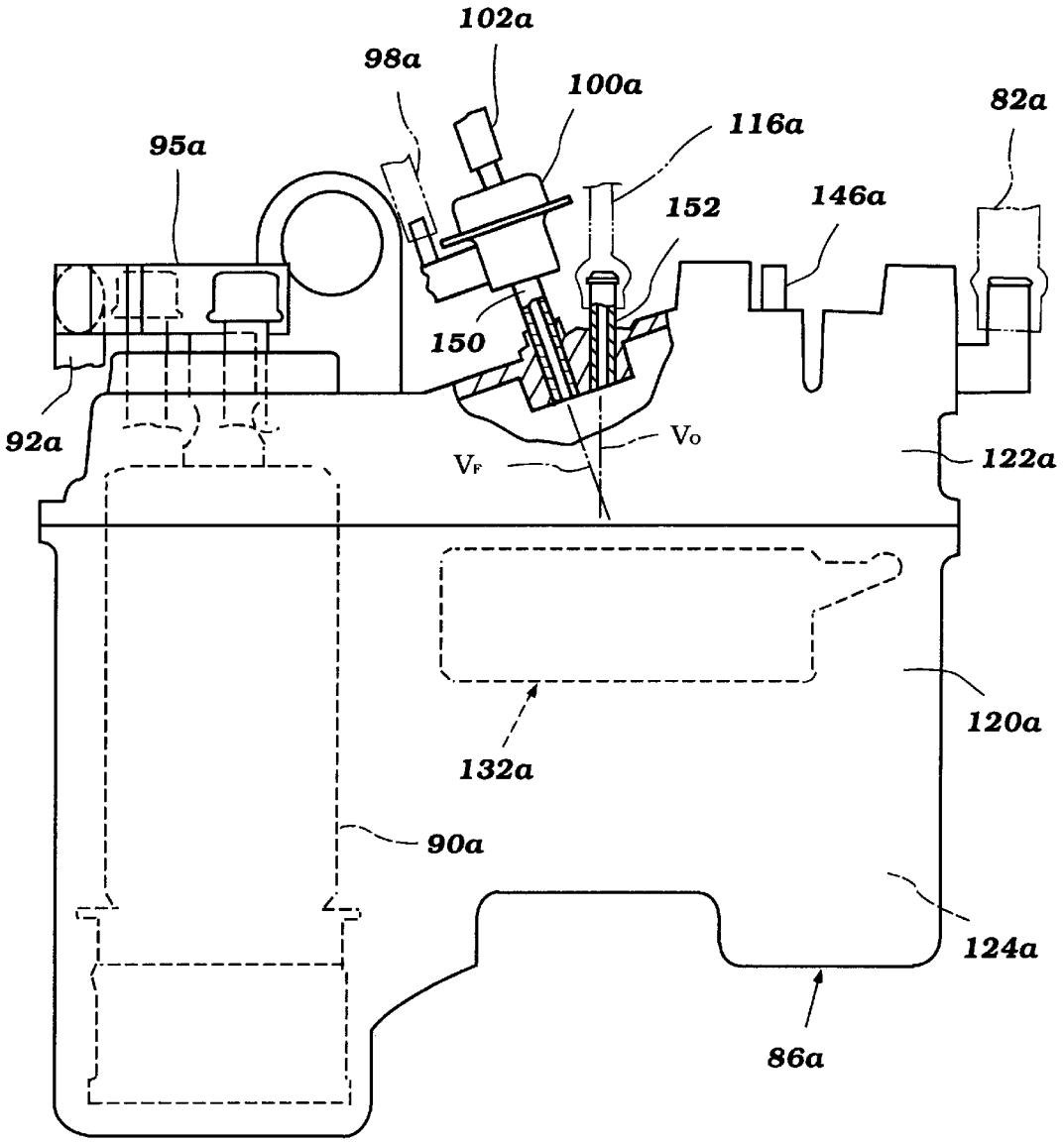
FIG. 6 is a side view, in partial cross-section, of a vapor separator of a fuel system in accordance with a second embodiment of the present invention.

FIG. 6 illustrates a second embodiment fuel system in accordance with the present invention. In this figure like parts have been given like numbers as to the embodiment illustrated in FIGS. 1–5 and described above, and include an "a" designator. In this embodiment, fuel which passes through the return line 98*a* passes through a passage 150 into the chamber 124*a*. On the other hand, the oil is supplied into the separator 86*a* from line 116*a* through a separate oil supply passage 152.

Unlike the arrangement describe above where the oil and fuel is mixed as it enters the chamber, in this arrangement the oil and fuels streams are mixed within the chamber 124*a*. In particular, the fuel passage 150 extends along a line $V_f$, while the oil passage 152 extends along a line $V_O$. These two lines intersect within the chamber 124*a*. In this manner, the oil is thoroughly mixed with the returned fuel.

Figure 4:
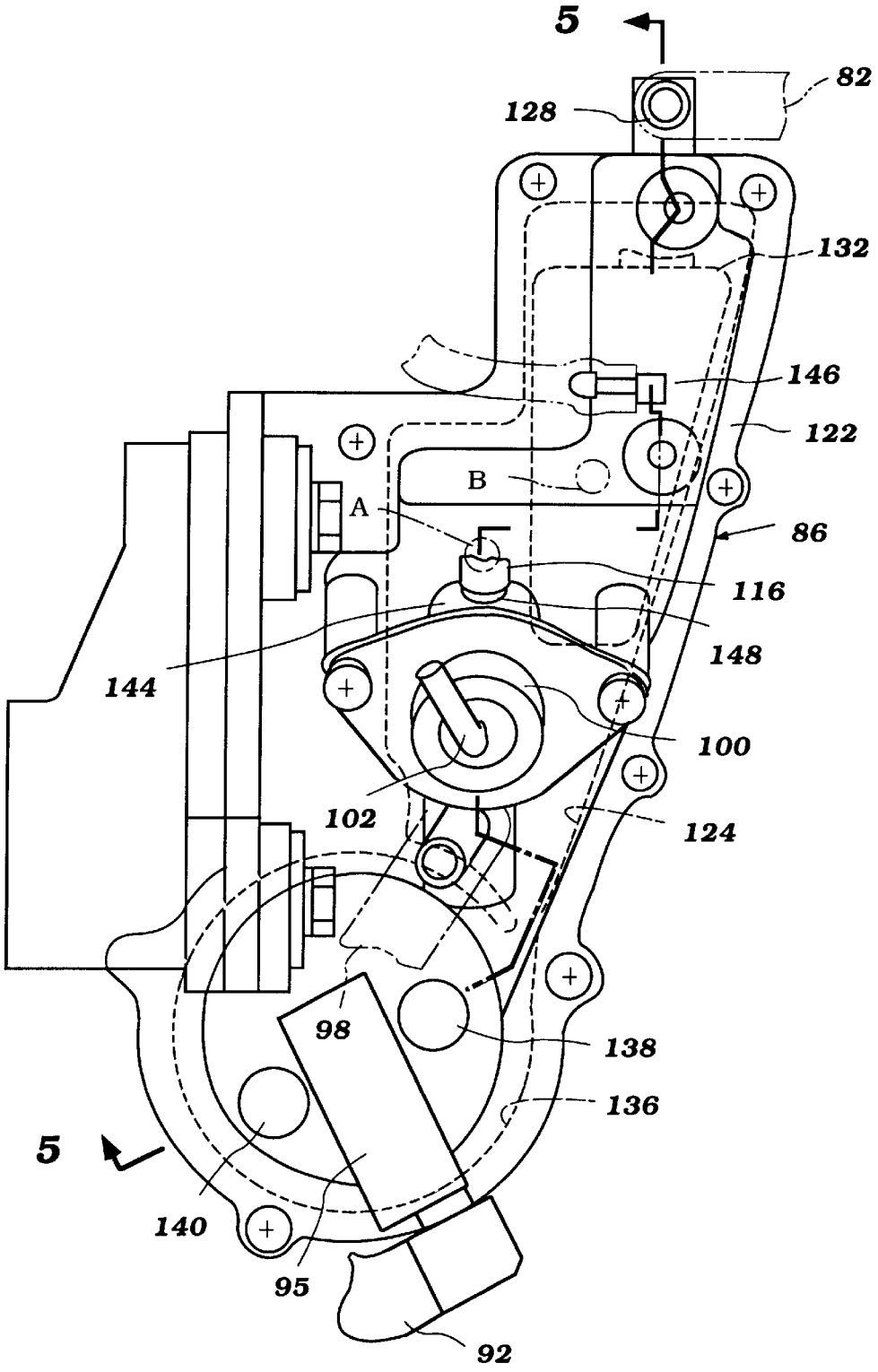
FIG. 4 is an enlarged top view of a vapor separator of the first embodiment fuel system of the present invention.

Preferably, the oil passage 152 extends through a top surface of the separator 86*a* at a point "A" as illustrated in FIG. 4, in relation to the fuel return passage 150.

Figure 7:
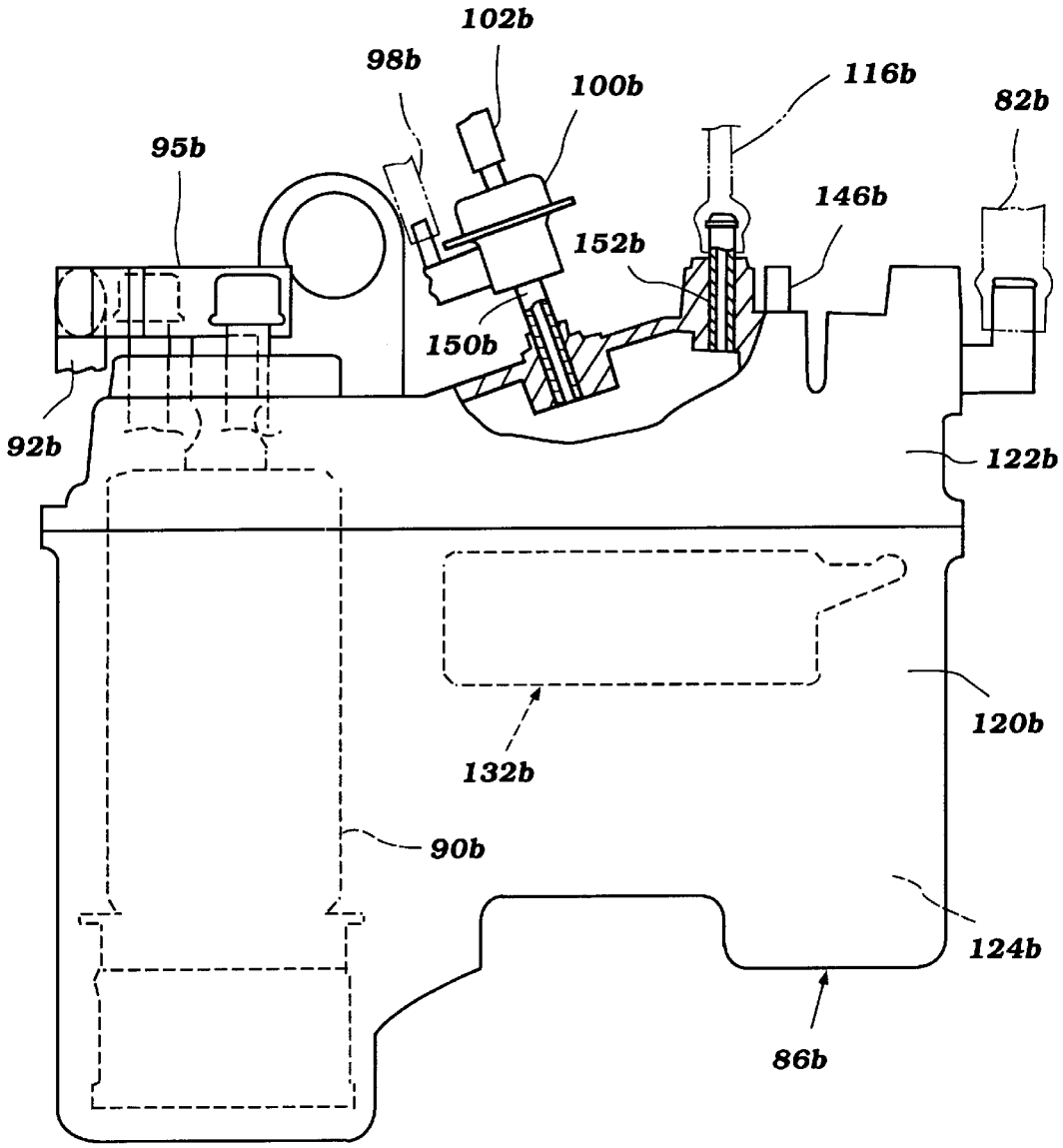
FIG. 7 is a side view, in partial cross-section, of a vapor separator of a fuel system in accordance with a third embodiment of the present invention.

FIG. 7 illustrates a third embodiment fuel system in accordance with the present invention. In this figure, like parts have been given like numbers as to the embodiments illustrated and described above, and include a "b" designator. In this arrangement, the oil passage 152*b* is positioned in the top surface or lid 122*b* of the separator 86*b* above the float 132*a*, and extends generally perpendicular to the chamber 124*a*. The position of the passage 152*b* through the lid 122*b* is illustrated in FIG. 4 as point "B."

In this arrangement, the incoming oil impacts the float 132*b* and is distributed throughout the chamber 124*b*. In this manner, the oil is mixed with the fuel.

Figure 8:
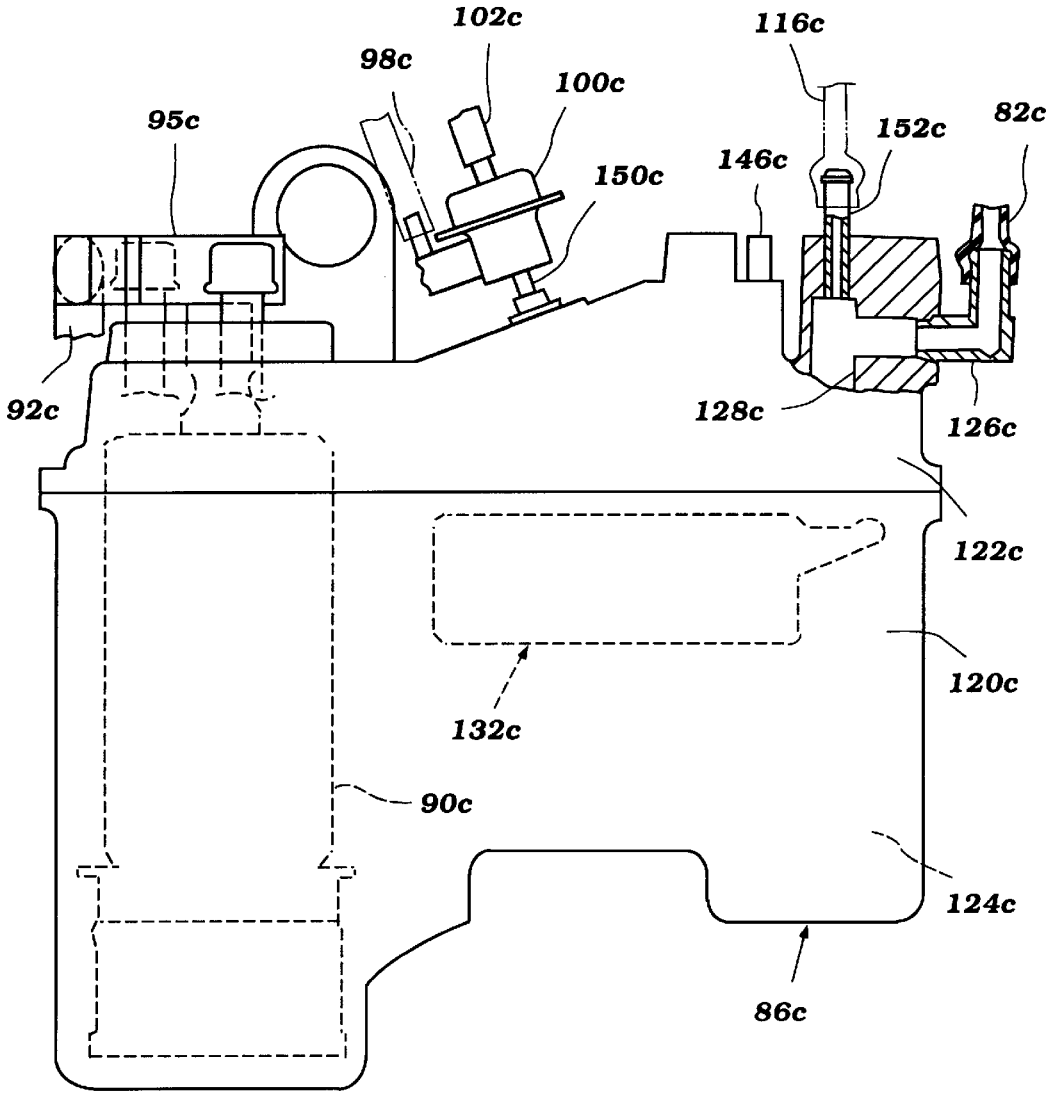
FIG. 8 is a side view, in partial cross-section, of a vapor separator of a fuel system in accordance with a fourth embodiment of the present invention.

FIG. 8 illustrates a fourth embodiment fuel system in accordance with the present invention. In this figure, like parts have been given like numbers as to the embodiments illustrated and described above, and include a "*c*" designator. In this arrangement, the fuel which is returned from the return fuel line 98*c* passes into the chamber 124*c* through the passage 150*c*.

The oil supply line 116*c* extends in communication with the fuel supply passage 128*c* in the lid 122*c* of the vapor separator 86*c*. The oil is mixed with the fuel which is supplied through the main supply line 82*c*, and then routed into the chamber 124*c* of the separator.

Figure 9:
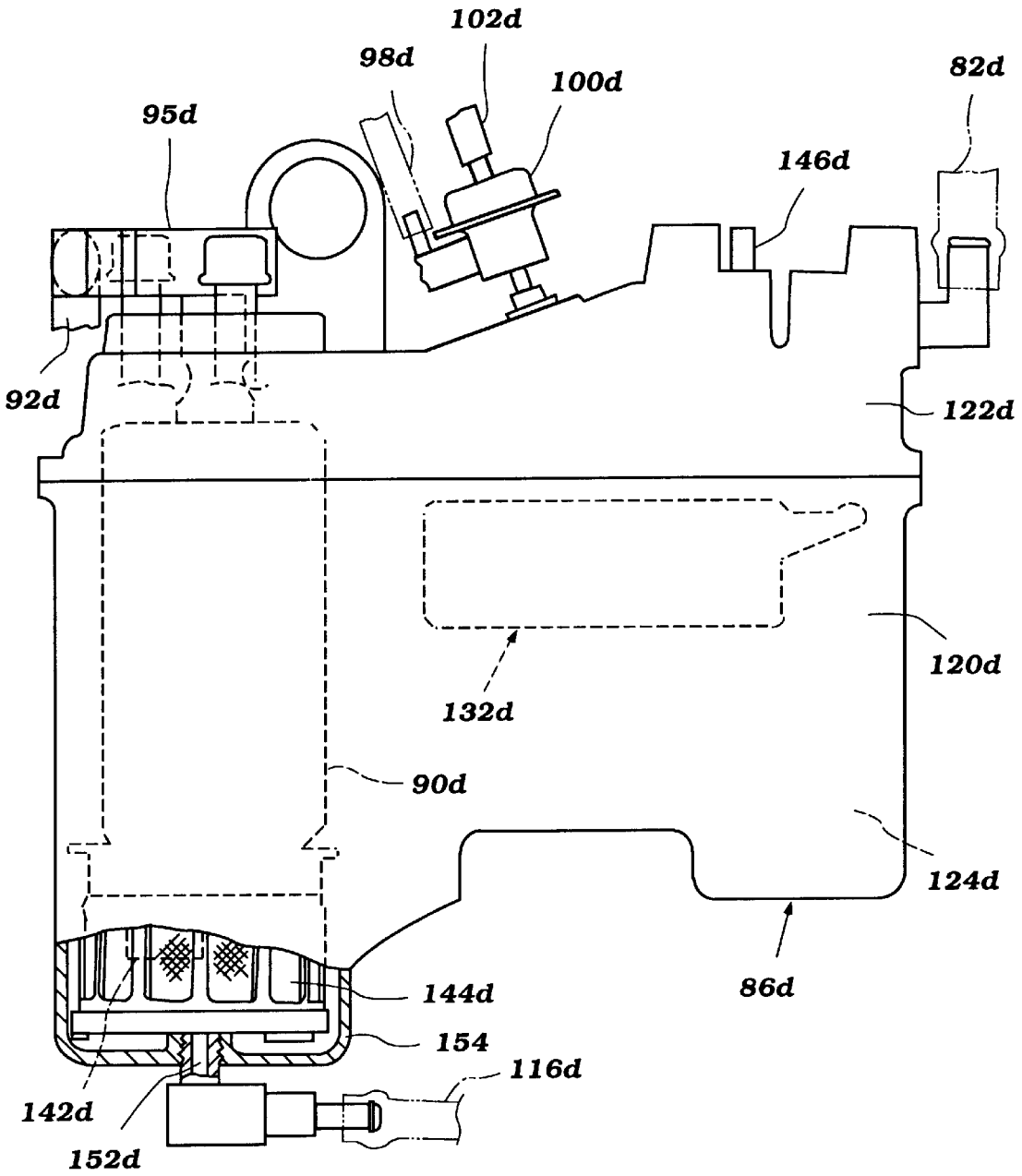
FIG. 9 is a side view, in partial cross-section, of a vapor separator of a fuel system in accordance with a fifth embodiment of the present invention.

FIG. 9 illustrates a fifth embodiment fuel system in accordance with the present invention. In this figure, like parts have been given like numbers as to the embodiments illustrated and described above, and include a "d" designator. In this arrangement, the oil is supplied through the supply line 116*d* to a passage 152*d* leading to the filter area 144*d* near the intake 142*d* of the high pressure pump 90*d*. The passage 152*d* extends through a bottom wall 154 of the separator 86*d*.

In this arrangement, the oil is mixed with the fuel at the point near the high pressure pump inlet 142*d*, whereby the high pressure pump readily picks up a mixture of the oil and fuel for delivery to the high pressure fuel line 92*d*.

Figure 10:
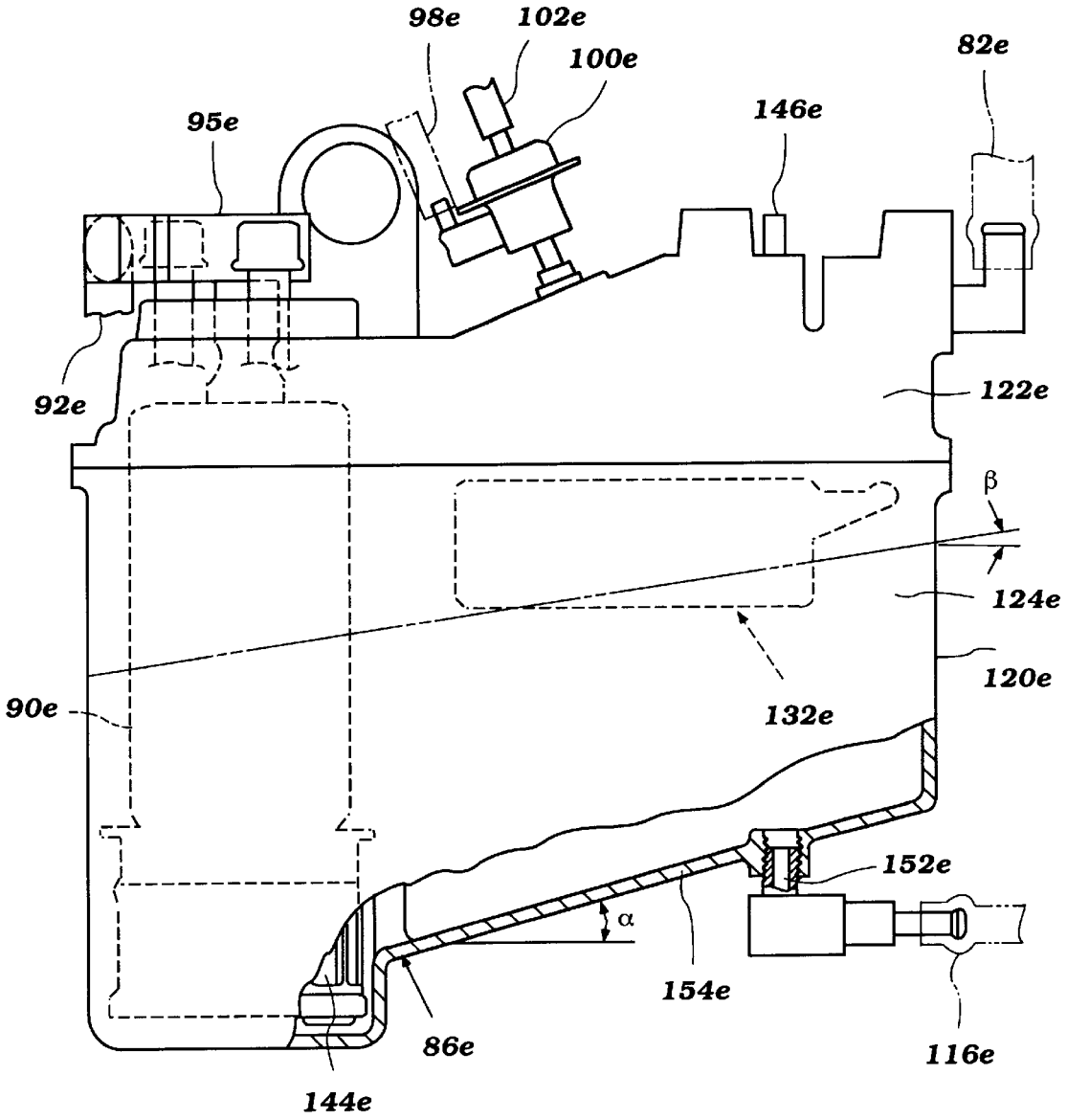
FIG. 10 is a side view, in partial cross-section, of a vapor separator of a fuel system in accordance with a sixth embodiment of the present invention.

FIG. 10 illustrates a sixth embodiment fuel system in accordance with the present invention. In this figure, like parts have been given like numbers as to the embodiments illustrated and described above, and include an "e" designator. In this arrangement, the oil is supplied through the supply line 116*e* and passage 152*e* into the bottom of the vapor separator 86*e* generally at a side thereof generally opposite the filter 144*e*. The bottom wall 154*e* of the vapor separator 86*e* is slanted downwardly in the direction from the oil supply inlet to the filter 144*e*. In particular, the angle a a which the bottom wall 154*e* slopes relative to horizontal is preferably larger than the maximum angle β which the top surface of the liquid within the chamber 124*e* assumes with respect to horizontal during watercraft acceleration or when the motor is trimmed. In this manner, the oil always has the tendency to move towards the intake of the high pressure pump 90*e*.

Figure 11:
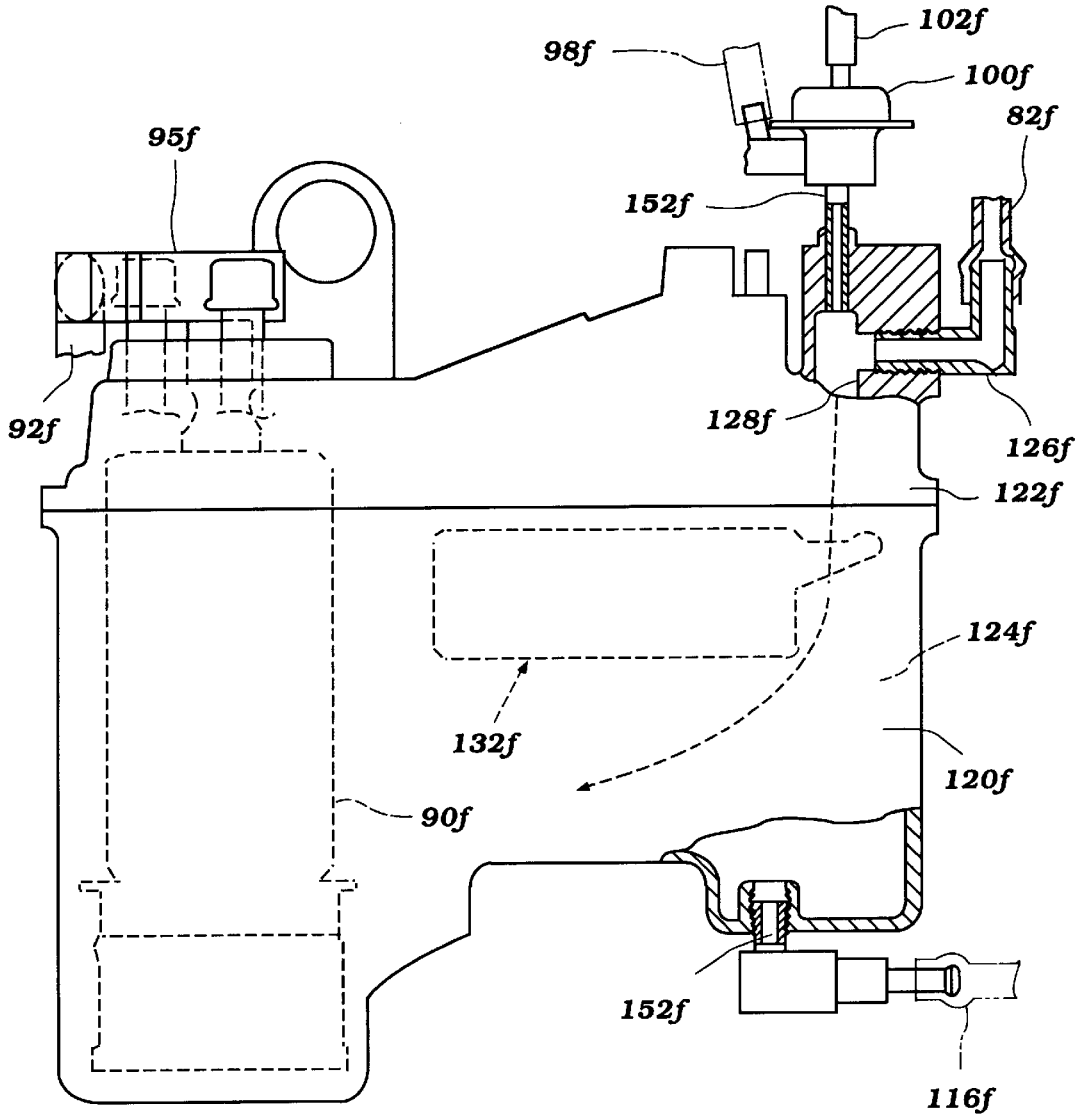
FIG. 11 is a side view, in partial cross-section, of a vapor separator of a fuel system in accordance with a seventh embodiment of the present invention.

FIG. 11 illustrates a seventh embodiment fuel system in accordance with the present invention. In this figure, like parts have been given like numbers as to the embodiments illustrated and described above, and include an "f" designator. In this arrangement, the fuel returned through the pressure regulator 100*f* is merged in the passage 128*f* with the main fuel supply from the line 82*f*. This flow of fuel flows from the passage 128*f* and downwardly through the fuel in the chamber 124*f* where it mixes with oil supplied to the chamber. The oil is preferably supplied through the line 116*f* and passage 152*f* to the chamber 124*f* to a point at the bottom of he separator 86*f*. This location is such that the incoming fuel stream agitates and sweeps into its flow the oil, whereby the oil and fuel are mixed.

Figure 12:
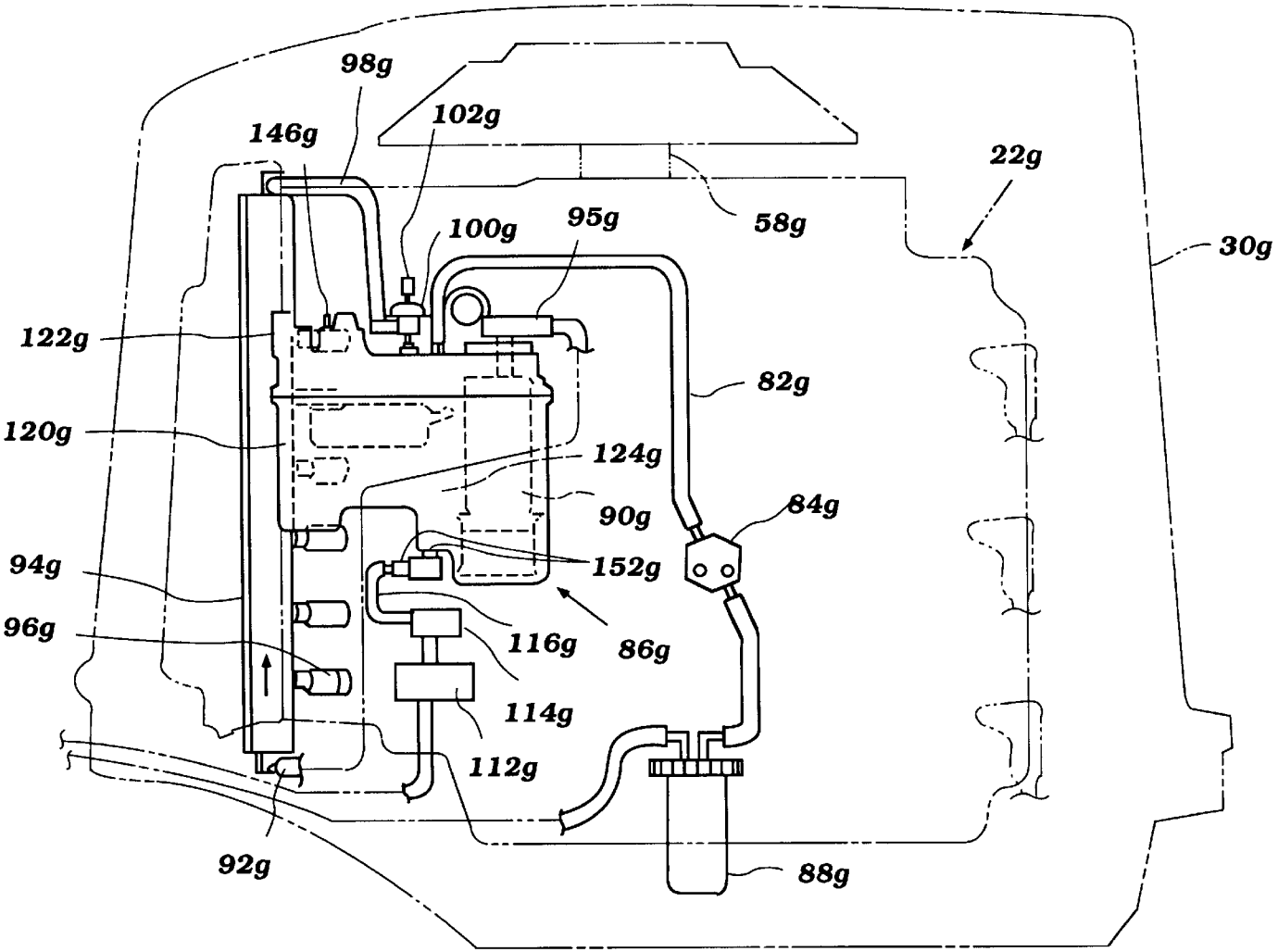
FIG. 12 is a side view, in partial cross-section, of a vapor separator of a fuel system in accordance with a eighth embodiment of the present invention.

FIG. 12 illustrates a seventh embodiment fuel system in accordance with the present invention. In this figure, like parts have been given like numbers as to the embodiments illustrated and described above, and include an "g" designator. In this arrangement, the separator 86*g* is designed such that the high pressure fuel pump 90*g* is positioned within that portion of the separator closest to or facing the watercraft. In addition, the oil is supplied through the line 116*g* and connector 152*g* into the bottom of the chamber 124*g* of the separator 86*g* adjacent the intake of the pump 90*g*. The fuel supplied through the main supply line 82*g* and return line 98*g* are both delivered through the top of the separator 86*g*.

In accordance with the present invention, a fuel system is provided for an engine of powering an outboard motor of a watercraft. The fuel system includes means for introducing oil into the fuel so that a mixture of oil and fuel is drawn from a vapor separator for delivery to the fuel injectors. The vapor separator is configured to ensure that the oil is pumped from the separator by a high pressure fuel pump even when the outboard motor is trimmed or the watercraft is accelerating.

Of course, the foregoing description is that of preferred embodiments of the invention, and various changes and modifications may be made without departing from the spirit and scope of the invention, as defined by the appended claims.

What is claimed is:

1. A fuel supply system for an internal combustion engine, said supply system including a vapor separator having a chamber therein, at least one charge former, a main fuel supply supplying fuel to said chamber of said vapor separator, a float is positioned within said vapor separator for controlling the flow of fuel into said chamber from said main supply, an oil supply supplying oil to said chamber of said separator through an oil supply port in said separator positioned above said float, a combined oil and fuel supply delivering an oil and fuel mixture from said chamber to said at least one charge former, a fuel return for returning fuel and oil not delivered to said engine by said at least one charge former to said chamber of said vapor separator.

2. The fuel supply system in accordance with claim 1, wherein said oil is supplied into said fuel and oil mixture passing through a port extending into said chamber.

3. The fuel supply system in accordance wit claim 1, wherein said fuel and oil mixture is returned in a stream through a port in said separator intersecting said oil is supplied oil supply port in said separator.

4. The fuel supply system in accordance with claim 1, wherein said combined fuel and oil supply comprises a high pressure pump having at least an intake thereof positioned in said chamber.

5. The fuel supply system in accordance with claim 4, wherein said intake is positioned in a portion of said chamber nearest a watercraft when said engine is mounted within a cowling of a motor utilized to power the watercraft.

6. The fuel supply system in accordance with claim 1, wherein said fuel and oil mixture supply comprises a high pressure pump having at least an intake thereof positioned in said chamber and a bottom surface of said separator slants towards said intake.

7. The fuel supply system in accordance with claim 1, wherein the oil is supplied to the chamber at a point in proximity to the point of fuel return for mixing with the fuel return to the separator.

8. The fuel supply system in accordance with claim 7, wherein the oil is supplied to the return fuel before the return is delivered to the separator.

9. The fuel supply is accordance with claim 7, wherein the oil supply port and the fuel are juxtaposed to each other and both positioned above the float.

* * * * *

UNITED STATES PATENT AND TRADEMARK OFFICE
CERTIFICATE OF CORRECTION

PATENT NO. : 6,006,705

DATED : December 28, 1999

INVENTOR(S): Kato et al.

It is certified that error appears in the above-identified patent and that said Letters Patent is hereby corrected as shown below:

In Claim 3, column 8, line 29, "said oil is supplied oil supply port" should be --said oil supply port--.

In Claim 8, column 8, line 48, "return is" should be --return fuel is--.

In Claim 9, column 8, line 51, "supply is" should be --supply in--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*